US005574549A

United States Patent [19]

Sundquist

[11] Patent Number: 5,574,549

[45] Date of Patent: Nov. 12, 1996

[54] CONTAINER COUPLING MEMBER

[75] Inventor: John D. Sundquist, Clarksville, Va.

[73] Assignee: Xerox Corporation, Stamford, Conn.

[21] Appl. No.: 254,204

[22] Filed: Jun. 6, 1994

[51] Int. Cl.[6] ..... G03G 15/06

[52] U.S. Cl. ..... 399/262; 222/DIG. 1; 399/120

[58] Field of Search ..... 355/260; 222/DIG. 1, 222/610, 181, 540, 180, 181.1; 206/515, 516, 517, 514; 220/481, 737

[56] References Cited

U.S. PATENT DOCUMENTS

| | | | |
|---|---|---|---|
| 3,596,795 | 8/1971 | D'Ercoli . | |
| 4,478,512 | 10/1984 | Zoltner | 355/260 |
| 4,548,348 | 10/1985 | Clements | 220/410 X |
| 4,614,165 | 9/1986 | Folkins et al. | 118/657 |
| 4,827,307 | 5/1989 | Zoltner | 355/215 |
| 4,937,628 | 6/1990 | Cipolla et al. | 355/260 |
| 5,034,776 | 7/1991 | Sugiura | 355/260 |
| 5,078,303 | 1/1992 | Kikuchi et al. | 222/DIG. 1 X |
| 5,207,353 | 5/1993 | Corby et al. | 222/DIG. 1 X |
| 5,235,389 | 8/1993 | Kikuchi et al. | 355/260 |
| 5,266,998 | 11/1993 | Lee | 355/260 X |
| 5,299,700 | 4/1994 | Beniacar | 220/410 X |
| 5,428,436 | 6/1995 | Sundquist et al. | 355/260 |

*Primary Examiner*—Robert Beatty
*Attorney, Agent, or Firm*—Zosan S. Soong

[57] ABSTRACT

An assembly is disclosed comprising: (a) a coupling member comprising a cradle portion defining a container receiving space, and including a first side end having a first flange which extends into the receiving space and a second side end having a second flange which extends into the receiving space; and (b) a first container including one or more outer surface protuberances, wherein the first container is partially disposed in the container receiving space and at least a portion of the first flange and at least a portion of the second flange contact the outer surface of the first container to define a first region of the outer surface of the first container below the first flange and the second flange, wherein the one or more protuberances, disposed in the first region, minimize movement of the first region above the first flange and the second flange by engaging the first flange or the second flange when the first container is subjected to movement out of the receiving space, thereby coupling the first container to the coupling member.

18 Claims, 5 Drawing Sheets

CONTAINER COUPLING MEMBER

This invention relates generally to a container coupling member and more specifically to a container coupling member which can releasably couple both the housing of a toner cartridge and the housing of a waste sump. The assembly comprised of the toner cartridge housing, waste sump housing, and the coupling member is placed in an electrostatographic printing apparatus, which includes printing and copying devices. Unless otherwise indicated herein, the phrases "toner cartridge" and "developer cartridge" have the same meaning.

In the process of electrostatographic printing, a charge-retentive surface, such as a photoreceptor, is charged to a substantially uniform potential so as to sensitize the surface thereof. The charged portion of the photoconductive surface is exposed to a light image of an original document being reproduced, or else a scanned laser image created by the action of digital image data acting on a laser source. The scanning or exposing step records an electrostatic latent image on the photoreceptor corresponding to the informational areas in the document to be printed or copied. After the latent image is recorded on the photoreceptor, the latent image is developed by causing toner particles to adhere electrostatically to the charged areas forming the image. This developed image on the photoreceptor is subsequently transferred to a sheet on which the desired image is to be printed. Finally, the toner on the sheet is heated to permanently fuse it to the sheet in image configuration.

One familiar type of development of an electrostatic image is called "two-component development." Two-component developer largely comprises toner particles interspersed with carrier particles. The carrier particles are magnetically attractable, and the toner particles are caused to adhere triboelectrically to the carrier particles. This two-component developer can be conveyed, by means such as a "magnetic roll," to the electrostatic latent image, where toner particles become detached from the carrier particles and adhere as desired to the electrostatic latent image.

Despite the practical advantages of two-component development, which has caused this type of development to become very common in printers and copiers available today, a common problem involving two-component development relates to the degradation of two-component developer material, that is the mixture of carrier and toner, over the life of a printer or copier. One print quality problem results from the fact that, whereas the toner in developer material is gradually consumed by being placed on the photoreceptor and then from the photoreceptor on to a print sheet with successive prints, a constant quantity of carrier particles remains in the system; the long-term result is that the ratio of toner to carrier particles in the developer mixture drifts from an optimal level. Further, the frequency of print quality defects tends to increase with the increasing length of service of a two-component development system. Such print quality defects may be caused by dirt generation from developer material which is nearing the end of its useful life. At service calls, however, developer material is frequently changed without knowing the condition thereof, which can result in an effective wasting of developer material.

Folkins et al., U.S. Pat. No. 4,614,165, the disclosure of which is totally incorporated by reference, discloses the general principle of what is known familiarly as "trickle" development. Very briefly, trickle development involves providing two distinct supplies of developer: a main supply, from which the development unit draws developer for application to the electrostatic latent image, and a second, separate developer supply which is used to replenish the first supply over time. Typically, the two quantities of developer have substantially different ratios of toner to carrier. In the embodiment described in the '165 patent, for example, the first developer supply in the housing of the development unit is 96% carrier by weight and 4% toner by weight, while the developer material being gradually dispensed into the first supply is 25% carrier by weight and 75% toner by weight. The idea is that, over the course of the lifetime of the printer, or at least of the development unit, the relatively toner-rich developer in the second supply is gradually discharged, or caused to "trickle," into the first developer supply. This trickling serves to maintain a substantially continuous replenishment of toner and carrier, thereby extending the useful life and the optimal print quality associated with the development unit.

Toner cartridges and electrostatographic printing apparatus are illustrated for example in Kikuchi et al., U.S. Pat. No. 5,235,389; Zoltner, U.S. Pat. No. 4,827,307; and Zoltner, U.S. Pat. No. 4,478,512, the disclosures of which are totally incorporated by reference.

DeYoung et al., U.S. appln. Ser. No. 08/236,080, now issued as U.S. Pat. No. 5,436,703 (Attorney Docket No. D/94189), filed May 2, 1994, titled "Development Unit For Electrostatographic Printing," the disclosure of which is totally incorporated by reference, discloses a development unit, developer cartridge, and waste sump suitable for use in "trickle" development, reference for example FIG. 3.

There is a need for a coupling member which can releasably couple together a toner cartridge housing and a waste sump housing to permit their installation inside a printing or copying device, wherein the coupling member also permits the separation of the toner cartridge housing from the assembly comprised of the coupling member and the waste sump housing for purposes of recycling or disposal.

SUMMARY OF THE INVENTION

It is an object in embodiments of the invention to provide a coupling member which can releasably couple together a toner cartridge housing and a waste sump housing to permit their installation inside a printing or copying device, wherein the coupling member also permits the separation of the toner cartridge housing from the assembly comprised of the coupling member and the waste sump housing for purposes of recycling or disposal. In embodiments, the waste sump housing is releasably coupled to the coupling member.

It is a further object in embodiments of the invention to provide an assembly comprised of a toner cartridge housing, a coupling member, and a waste sump housing, wherein the coupling member can maintain the correct machine functional position and alignment of the toner cartridge housing and waste sump housing inside a printing or copying device.

These objects and others are accomplished in embodiments by an assembly comprising:

(a) a coupling member comprising a cradle portion defining a container receiving space, and including a first side end having a first flange which extends into the receiving space and a second side end having a second flange which extends into the receiving space; and (b) a first container including one or more outer surface protuberances, wherein the first container is partially disposed in the container receiving space and at least a portion of the first flange and at least a portion of the second flange contact the outer surface of the first container to define a first region of the outer surface of the first container below the first flange and the second flange, wherein the one or more protuberances, disposed in the first region, minimize movement of the first region above the first flange and the second flange by engaging the first flange or the second flange when the first container is subjected to movement out of the receiving space, thereby coupling the first container to the coupling member.

In embodiments of the instant invention, there is further provided an assembly comprising:

(a) a coupling member comprising:

(i) a cradle portion defining a container receiving space, and including a first side end having a first flange which extends into the receiving space and a second side end having a second flange which extends into the receiving space; and (ii) means for coupling the coupling member to an indented surface, wherein the coupling means is associated with the cradle portion;

(b) a first container including one or more outer surface protuberances, wherein the first container is partially disposed in the container receiving space and at least a portion of the first flange and at least a portion of the second flange contact the outer surface of the first container to define a first region of the outer surface of the first container below the first flange and the second flange, wherein the one or more protuberances, disposed in the first region, minimize movement of the first region above the first flange and the second flange by engaging the first flange or the second flange when the first container is subjected to movement out of the receiving space, thereby coupling the first container to the coupling member; and (c) a second container including an indented surface, wherein the indented surface is coupled with the coupling means.

In additional embodiments of the instant invention, there is also provided a coupling member comprising:

(a) a cradle portion defining a container receiving space, and including a first side end having a first flange which extends into the receiving space and a second side end having a second flange which extends into the receiving space; and (b) means for coupling the coupling member to a second container, wherein the coupling means is associated with the cradle portion.

In embodiments of the instant invention, there is also provided an electrostatographic printing apparatus comprising:

(a) a coupling member comprising:

(i) a cradle portion defining a container receiving space, and including a first side end having a first flange which extends into the receiving space and a second side end having a second flange which extends into the receiving space; and (ii) means for coupling the coupling member to an indented surface, wherein the second portion is associated with the cradle portion;

(b) a first container defining a chamber containing developer particles, wherein the first container includes one or more outer surface protuberances, wherein the first container is partially disposed in the container receiving space and at least a portion of the first flange and at least a portion of the second flange contact the outer surface of the first container to define a first region of the outer surface of the first container below the first flange and the second flange, wherein the one or more protuberances, disposed in the first region, minimize movement of the first region above the first flange and the second flange by engaging the first flange or the second flange when the first container is subjected to movement out of the receiving space, thereby coupling the first container to the coupling member;

(c) a second container defining a chamber for storing waste developer particles, wherein the second container includes an indented surface, and wherein the indented surface is coupled with the coupling means; and (d) a charge-retentive surface.

BRIEF DESCRIPTION OF THE DRAWINGS

Other aspects of the present invention will become apparent as the following description proceeds and upon reference to the Figures which represent preferred embodiments and are substantially to scale:

In FIGS. 1–6, the first container may be the housing of a toner cartridge and the second container may be the housing of a waste sump. Unless otherwise noted, the same reference numeral in the Figures refers to the same or similar feature.

DETAILED DESCRIPTION

Figure 1:
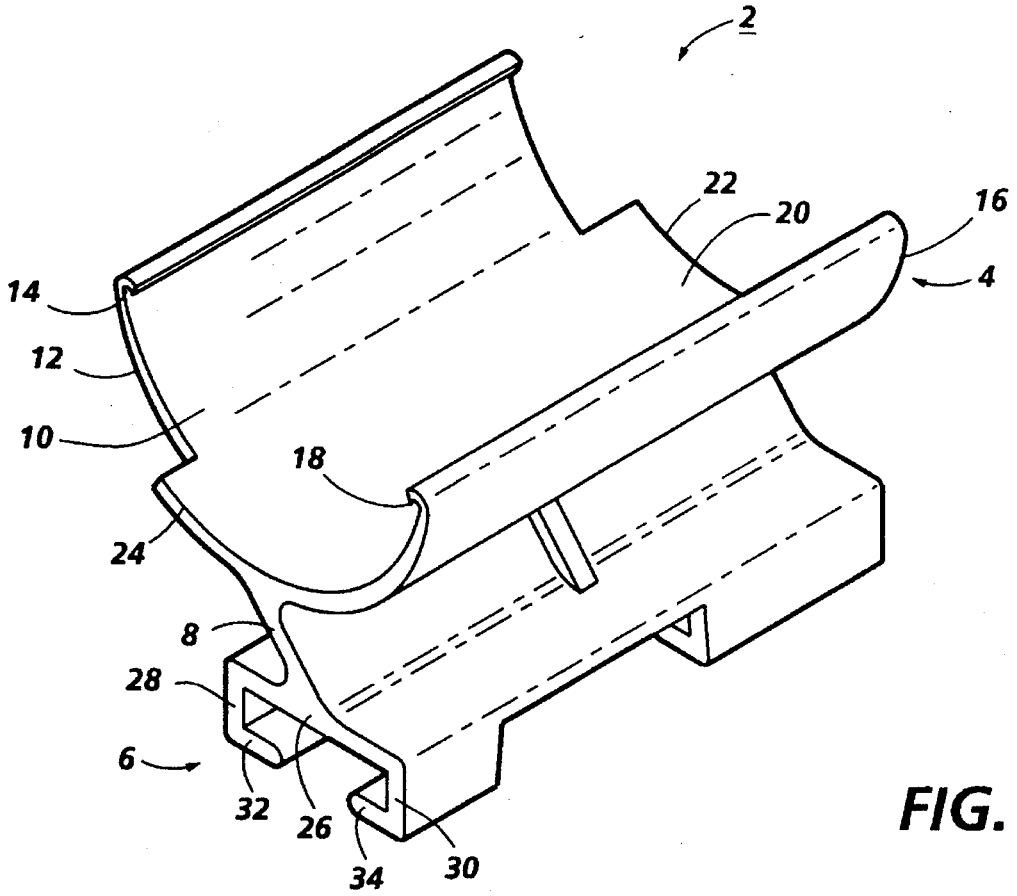
FIG. 1 is a perspective, schematic view of a coupling member.

In FIG. 1, a coupling member 2 is comprised of a cradle portion 4 for detachably coupling the coupling member 2 to a first container (not shown) and a means for coupling, preferably detachably, the coupling member 2 to a second container (not shown), wherein the coupling means 6 may be for instance a bracket. A connecting member 8 is coupled to the cradle portion 4 and the coupling means 6, thereby joining the cradle portion 4 and the coupling means 6.

The cradle portion 4 may have for example an arcuate shape or may be in the shape of a curved plate. The cradle portion 4 defines a container receiving space 10 and further includes a first side end 12 having a first flange 14 which extends into the receiving space 10 and a second side end 16 having a second flange 18 which extends into the receiving space 10. The flanges (14,18) may be parallel and opposite to one another, and may be at the same or different level. The flanges (14,18) may extend along a portion of, along selected portions of, or along the entire length of the side ends (12, 16), the first flange 14 and the second flange 18 having the same or different lengths and widths. Preferably, the cradle portion 4 conforms to the contour of the portion of the first container disposed in the receiving space 10. The cradle portion 4 may have a concave top surface 20, a container receiving space 10 defined by the top surface 20, and may include open front end 22 and open back end 24 to admit the first container to facilitate the coupling of the cradle portion to the first container. The cradle portion 4 may be of any effective configuration and dimensions. The flanges (14, 18) may have a width ranging for example from about 1 to about 3 mm. Preferably, the cradle portion 4 is dimensioned to accommodate in the container receiving space 10 the cross-sectional width of the first container.

The coupling means 6 may be for example a bracket which comprises a plate 26 having a top side and a bottom side, a first L-shaped member 28 and an opposed second L-shaped member 30, both the first and the second L-shaped members being joined to the bottom surface, wherein one leg of the first L-shaped member is parallel to the plate and defines a first groove engaging surface 32 (also described herein as a tongue member), wherein one leg of the second L-shaped member is parallel to the plate and defines a second groove engaging surface 34 (also described herein as a tongue member). The L-shaped members (28, 30) may extend along a portion of or along the entire length of the plate 26, the L-shaped members (28, 30) having the same or different dimensions. In embodiments, each L-shaped member (28, 30) may extend along a portion of the length of the plate 26 in two or more segments, separated by a gap between segments. In embodiments of the present invention, the coupling means 6 may couple the coupling member 2 to any indented surface of the second container defining for example one, two or more grooves, a circular depression, an oval depression, and the like. The coupling means 6 may have any effective configuration and dimensions.

The coupling means 6 and the cradle portion 4 may be coupled together by any suitable apparatus and method including for example connecting member 8 which may a rigid strut-like member. The connecting member 8 may extend along a portion of or along the entire length of the cradle portion 4 and/or the coupling means 6. In embodiments, the connecting member 8 is angled with respect to plate 26 and to the bottom surface of the cradle portion 4 to accommodate the combined assembly of the first container, the coupling member, and the second container inside for example an electrostatographic printing or copying device. The connecting member may have any suitable configuration and dimensions.

The coupling member 2 preferably is an integral device, especially a single piece device. The coupling member 2 may be fabricated from any suitable material, preferably a plastic material such as polypropylene, and may be fabricated by any suitable technique including for example injection molding, a technique known to those skilled in the art.

Figure 2:
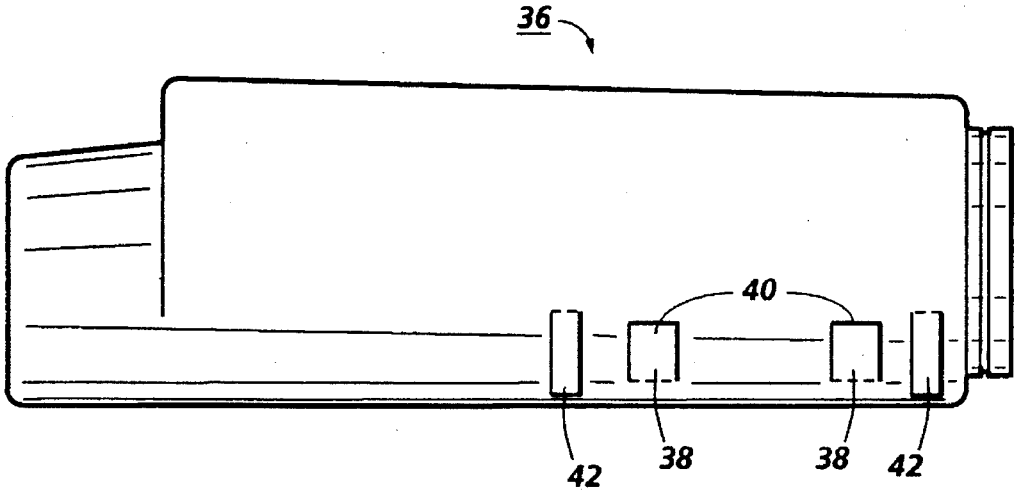
FIG. 2 is a side, schematic view of a first container.

FIG. 2 discloses a first container 36 which may be the housing of a toner cartridge to accommodate developer particles. Unless otherwise indicated herein, the term developer refers to a mixture of toner and carrier particles, or to toner particles without carrier particles. In embodiments where the first container 36 is the housing of a toner cartridge, additional components (which are not depicted) may be coupled to or disposed within the first container 36 including for example a mixing auger disposed within the chamber of the first container, a sealing member, and the like.

The first container 36 may have a generally cylindrical shape with for example a section having an arcuately-shaped outer surface. FIG. 2 discloses two protuberances 38, each defining an edge surface 40. Two additional protuberances (shown in FIGS. 3 and 5) are located on the opposite side of the first container, each defining an edge surface 40. These two additional protuberances 38 may have a similar dimension, configuration, and alignment as the protuberances 38 depicted in FIG. 2. The protuberances 38 of the first container 36 may have any suitable shape, dimensions, and configuration. For example, the protuberances 38 may be circular, rectangular, oval, square, and the like. The edge surface 40 defined by the protuberances 38 is akin to a shelf or ledge. The one or more protuberances 38 may be at the same or different level on the first container 36. The protuberances 38 may extend a distance ranging for example from about 1 mm to about 10 mm, compared to the surrounding smooth surface of the first container 36. There may be one protuberance or a plurality such as two, three, four or more. In embodiments, there may be a single protuberance which extends around a portion of the circumference of the first container and which presents two edge surfaces. The protuberances preferably are a molded feature of the first container, but may be integral attachments coupled to the outer surface in embodiments of the instant invention.

The first container 36 may also include optional guide bumps 42 to prevent or minimize horizontal movement of the first container 36 while coupled to the coupling member 2. Guide bumps 42 also may be a molded feature which may be disposed on one or both sides of the first container 36.

The first container 36 may be fabricated by any suitable process such as blow molding. Blow molding is preferred since it is relatively inexpensive and the protuberances may be a molded feature, corresponding to indentations in the inner surface and to raised areas on the outer surface of the first container. It is preferred that the protuberances correspond to indentations in the inner surface of the first container because such indentations will minimize interference with apparatus like a mixing auger; if there were projections on the inner surface of the first container, such projections may contact and interfere with the blades of the mixing auger. Preferred materials for the first container include a plastic material such as high density polyethylene.

Figure 3:
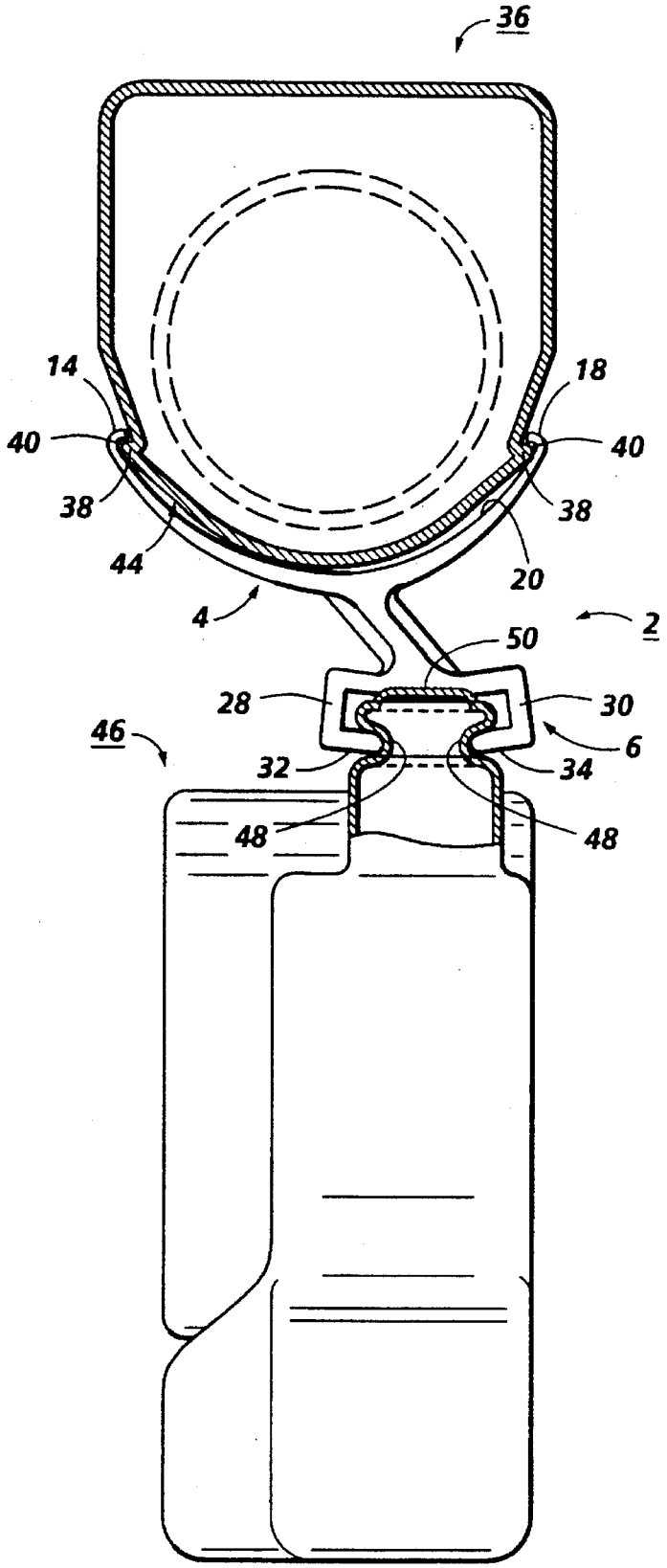
FIG. 3 is a schematic, end view of an assembly comprised of the first container, the coupling member, and the second container.

FIG. 3 discloses an end view of the assembly comprised of the first container 36 and the second container 46 coupled to coupling member 2. The cradle portion 4 comprises a section, preferably having an arcuately-shaped outer surface, which may be in contact with a part of the top surface 20 of the cradle portion 4. The first flange 14 and the second flange 18 preferably contact the surface of the first container 36, especially in a snug fit, to define a first region 44 of the outer surface of the first container 36 which is below the first flange 14 and the second flange 18. The protuberances 38 are disposed in the first region 44 below the first flange 14 and the second flange 18. Preferably, the one or more protuberances 38 have an edge surface 40 adjacent the first flange 14 or the second flange 18. The edge surface may extend along a portion or along the entire length of the first flange or the second flange, depending on the shape of the one or more protuberances. The protuberances 38 minimize or prevent movement of the first region 44 above the first flange 14 and the second flange 18 by engaging the first flange or the second flange when the first container is subjected to a vertical force or movement out of the container receiving space 10. In embodiments, the cradle portion 4 possesses sufficient flexibility, such flexibility attained by fabricating the coupling member from for example a plastic material as disclosed herein, to undergo bending when subjected to a bending force to allow coupling and decoupling of the first container to the cradle portion. To seat the first container into the cradle portion; the first region 44 of the first container 36 is pushed down into the cradle portion 4 until the flanges (14, 18) snap over the protuberances 38 and the edge surfaces 40 of the protuberances are directly below the flanges (14, 18). To uncouple the first container and the cradle portion, the first flange or the second flange is pulled back away from the outer surface of the first container to allow unimpeded movement of the first region including the one or more protuberances up and away from the cradle portion. Thus, the cradle portion is adapted to releasably couple the first container.

The second container 46 may be the housing of a waste sump for waste developer for electrostatographic printing and copying devices. Waste sumps are well known to those skilled in the art. The top of the second container 46 may include an indented surface 48 to provide a way to couple to the coupling member. As depicted in FIG. 3, the indented surface 48 may be in the form of a groove, preferably two opposed grooves. In embodiments, the indented surface of the second container may also be in the form of a circular depression, an oval depression, and the like. Thus, the coupling means 6 of the coupling member may be slidably engaged with the indented surface 48 of the second container in a releasably coupling manner. The top surface of the second container 46 may have one, two, or more bumps 50 (better seen in FIGS. 4 and 5) to impede movement of the bracket 6 once it is in position to minimize unintentional release of the second container 46 from the coupling member 2. The bumps 50 may be a molded feature. In embodiments, the second container may be coupled to the coupling member in a nonreleasably engaging manner. In particular instances of the present invention, the second container may be more tightly engaged to the coupling means than the first container is to the cradle portion. The second container may be fabricated by any suitable method including for example blow molding. Suitable materials to fabricate the second container include those disclosed herein for the first container.

Figure 4:
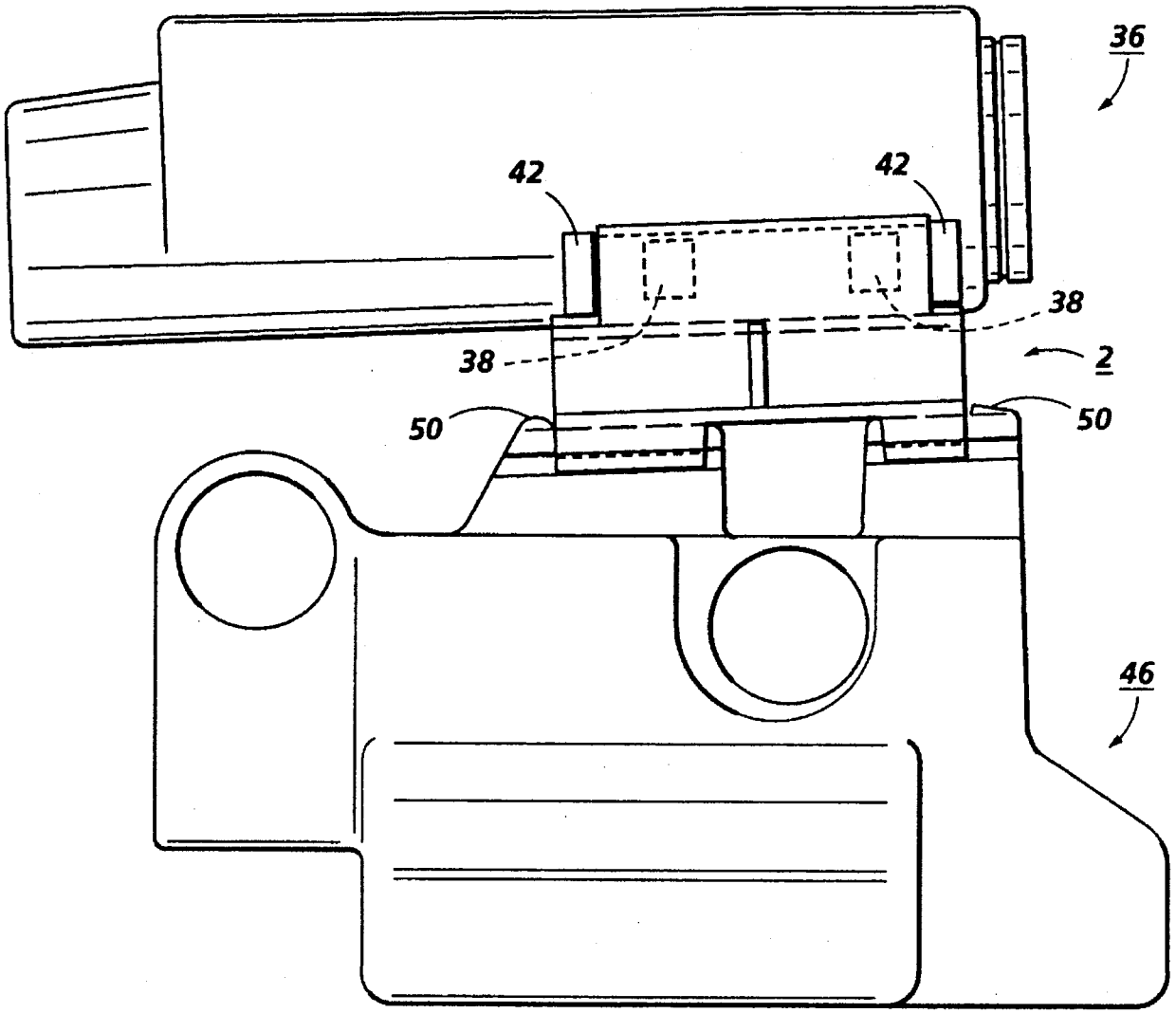
FIG. 4 is a side, schematic view of an assembly comprised of the first container, the coupling member, and the second container.

FIG. 4 discloses a side view of the assembly comprised of the first container 36 and the second container 46 coupled to the coupling member 2.

Figure 5:
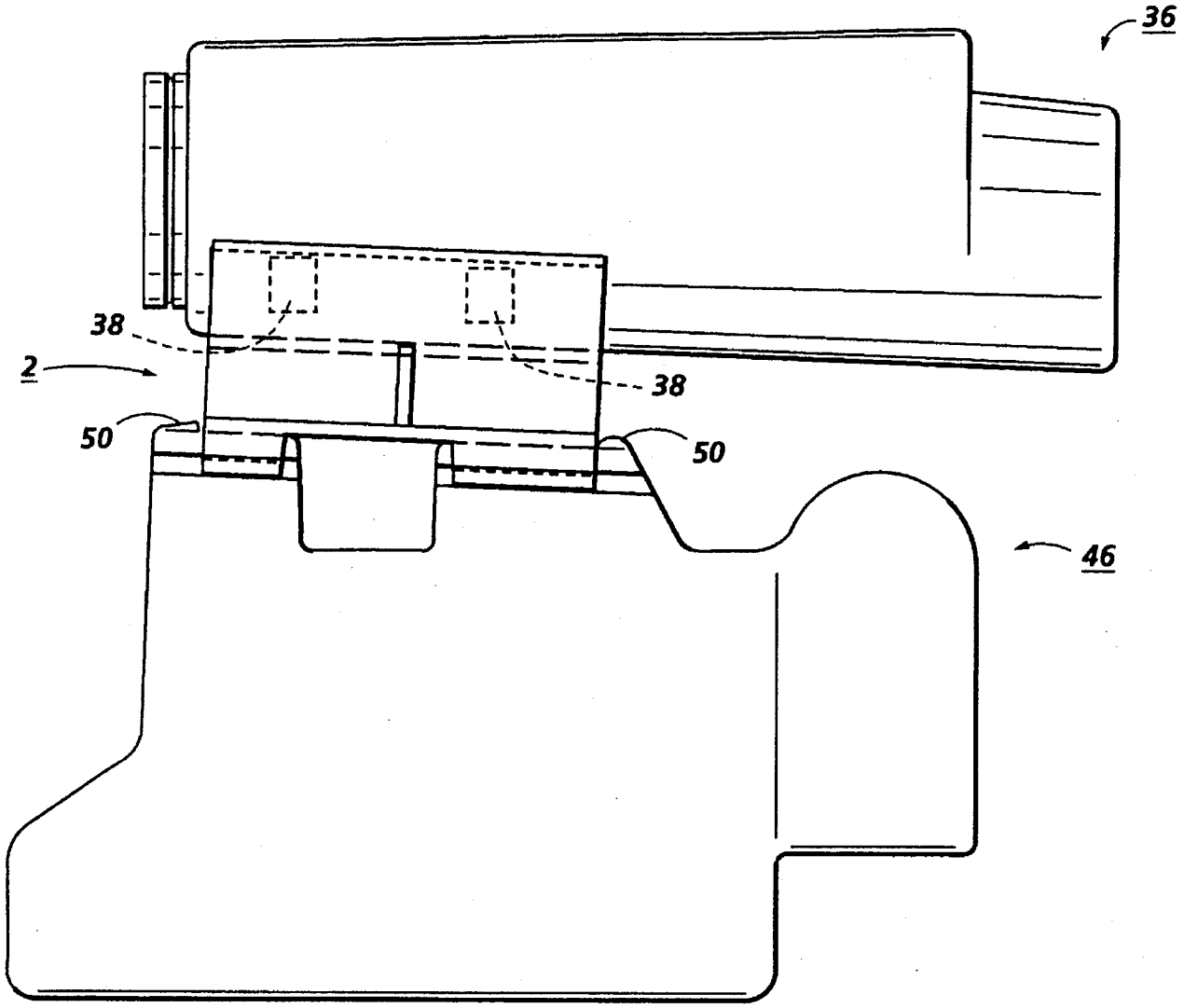
FIG. 5 is another side, schematic view of an assembly comprised of the first container, the coupling member, and the second container as viewed from the opposite side of the assembly disclosed in FIG. 4.

FIG. 5 discloses another side view (opposite side of the view disclosed in FIG. 4) of the first container 36 and the second container 46 coupled to the coupling member 2.

Figure 6:
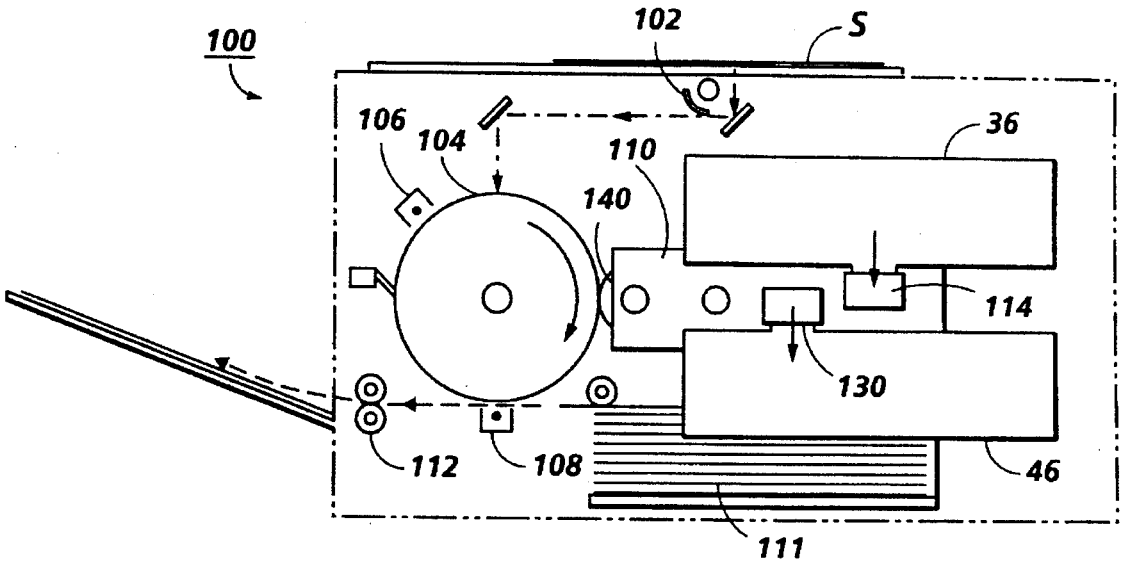
FIG. 6 is a schematic, side view showing the elements of an electrostatographic printer, in this case a copier, incorporating the assembly of the instant invention.

FIG. 6 shows the basic elements of an electrostatographic printer, in this case a copier, incorporating the present invention. The copier, generally indicated as 100, includes an exposure means 102, which may include a lamp, mirror, and self-focusing lens arrangement for obtaining an exposure of an original on sheet S to be copied. The image on sheet S is then exposed onto the surface of a photoreceptor 104 which has been previously charged by means of a corotron 106. When the charged surface of photoreceptor 104 is exposed to the image on sheet S, various portions of the surface will be discharged in imagewise fashion as they are exposed to light from the image. Those areas of the photoreceptor 104 which were not discharged in the exposure step are then developed by development unit 110, and in particular by the magnetic roll 140, so that toner is caused to adhere to the charged areas of photoreceptor 4, creating a "developed" image of the original. This developed image is then moved, by the rotation of photoreceptor 104, to a transfer station 108, where the toner on the photoreceptor is electrostatically transferred to a sheet of plain paper from stack 111. The sheet from stack 111 which receives the toner particles in imagewise fashion, is then sent through a fuser 112, which causes the toner particles to be melted onto the sheet to form a permanent image.

The present invention is particularly useful for electrostatographic printing apparatus which utilize "trickle" development. As mentioned above, in trickle development, there is provided a main supply of developer, which is drawn upon for application to an electrostatic latent image on photoreceptor 104, and a second supply of developer, which gradually discharges, or trickles, into the main developer supply. In most embodiments of trickle development, the main and secondary supplies of developer have substantially different percentages of toner to carrier particles (also referred to herein as "T/C"). The main developer supply is retained in the development unit 110, while the secondary developer supply is discharged into the development unit 110 through input port 114. Simultaneously, in order to maintain both a relatively stable amount of developer in development unit 110, and also to maintain the T/C of the developer in development unit 110 within an optimal range, a certain quantity of developer is discharged through output port 130.

In FIG. 6 can be seen, interacting with development unit 110, a first container 36 (which is the housing of a developer cartridge), and a second container 46 (which is the housing of a waste sump). A coupling member (not shown) couples the first container 36 to the second container 46. First container 36 can supply either toner alone or toner and carrier particles to input port 114 of development unit 110, while the second container 46 receives used developer from output port 130. In a typical trickle-development arrangement, the developer in the first container 36 will have a T/C of 25% carrier by weight and 75% toner by weight, while the developer in the development unit 110 will be maintained at a T/C of about 96% carrier by weight and 4% toner by weight. The assembly comprised of the first container, the second container, and the coupling member are removable from the printer apparatus, with a new assembly being installable by an end user.

Although, in the above-described embodiment of a trickle development system, it is intended that a secondary developer supply have a different T/C than the main developer supply within development unit 110, it is conceivable to provide a development unit wherein the developer being input into the development unit is of the same T/C as the developer already in the development unit, possibly with equal-rate displacement of input and output developer through the development unit 110. It is also conceivable that, instead of a developer comprised of both toner and carrier particles being provided into input port 114, pure toner, with no carrier therein, be supplied into development unit 110.

Other modifications of the present invention may occur to those skilled in the art based upon a reading of the present disclosure and these modifications are intended to be included within the scope of the present invention.

I claim:

1. An assembly comprising:

(a) a coupling member comprising: (i) a cradle portion defining a container receiving space, and including a first side end having a first flange which extends into the receiving space and a second side end having a second flange which extends into the receiving space, and (ii) means for coupling the coupling member to a second container, wherein the coupling means is associated with the cradle portion; and (b) a first container including one or more outer surface protuberances, wherein the first container is partially disposed in the container receiving space and at least a portion of the first flange and at least a portion of the second flange contact the outer surface of the first container to define a first region of the outer surface of the first container below the first flange and the second flange, wherein the one or more protuberances, disposed in the first region, minimize movement of the first region above the first flange and the second flange by engaging the first flange or the second flange when the first container is subjected to movement out of the receiving space, thereby coupling the first container to the coupling member, wherein the first container is releasably coupled to the coupling member by providing that the cradle portion possesses sufficient flexibility to undergo bending when subjected to a bending force to allow movement of the first flange or the second flange away from the outer surface of the first container, which permits the first region including the one or more protuberances to move above the first flange or the second flange, thereby releasing the first container from the coupling member.

2. The assembly of claim 1, wherein the cradle portion conforms to the contour of the portion of the first container disposed in the receiving space.

3. The assembly of claim 1, wherein the one or more protuberances have an edge surface adjacent the first flange or the second flange.

4. The assembly of claim 1, wherein the coupling member and the first container are fabricated from a plastic material.

5. The assembly of claim 1, wherein the first flange extends along the entire length of the first side end and the second flange extends along the entire length of the second side end.

6. The assembly of claim 1, wherein the first container includes two pairs of protuberances, wherein each protuberance of the first pair of protuberances has an edge surface adjacent the first flange, and wherein each protuberance of the second pair of protuberances has an edge surface adjacent the second flange.

7. The assembly of claim 1, wherein the cradle portion is in the shape of a curved plate.

8. The assembly of claim 1, wherein the cradle portion defines a concave top surface and the first container comprises a section having an arcuately-shaped outer surface which is in contact with a part of the concave top surface of the cradle portion.

9. The assembly of claim 1, wherein the coupling member is a single piece.

10. The assembly of claim 1, wherein the first container is fabricated by blow molding, resulting in the one or more protuberances corresponding to indentations in the inner surface of the first container and to raised areas on the outer surface of the first container.

11. An assembly comprising:

(a) a coupling member comprising:

(i) a cradle portion defining a container receiving space, and including a first side end having a first flange which extends into the receiving space and a second side end having a second flange which extends into the receiving space; and (ii) means for coupling the coupling member to an indented surface, wherein the coupling means is associated with the cradle portion;

(b) a first container including one or more outer surface protuberances, wherein the first container is partially disposed in the container receiving space and at least a portion of the first flange and at least a portion of the second flange contact the outer surface of the first container to define a first region of the outer surface of the first container below the first flange and the second flange, wherein the one or more protuberances, disposed in the first region, minimize movement of the first region above the first flange and the second flange by engaging the first flange or the second flange when the first container is subjected to movement out of the receiving space, thereby coupling the first container to the coupling member; and (c) a second container including an indented surface, wherein the indented surface is coupled with the coupling means, wherein the first container is releasably coupled to the coupling member by providing that the cradle portion possesses sufficient flexibility to undergo bending when subjected to a bending force to allow movement of the first flange or the second flange away from the outer surface of the first container, which permits the first region including the one or more protuberances to move above the first flange or the second flange, thereby releasing the first container from the coupling member.

12. The assembly of claim 11, wherein the coupling means comprises two, opposed tongue members.

13. The assembly of claim 11, wherein the indented surface of the second container defines at least one groove.

14. A coupling member comprising:

(a) a cradle portion defining a container receiving space for receiving a first container, and including a first side end having a first flange which extends into the receiving space and a second side end having a second flange which extends into the receiving space; and (b) means for coupling the coupling member to a second container, wherein the coupling means is associated with the cradle portion, wherein the first container is releasably coupled to the coupling member by providing that the cradle portion possesses sufficient flexibility to undergo bending when subjected to a bending force to allow movement of the first flange or the second flange away from the outer surface of the first container, thereby releasing the first container from the coupling member.

15. The coupling member of claim 14, wherein the coupling member is a single piece.

16. An electrostatographic printing apparatus comprising:

(a) a coupling member comprising:

(i) a cradle portion defining a container receiving space, and including a first side end having a first flange which extends into the receiving space and a second side end having a second flange which extends into the receiving space; and (ii) means for coupling the coupling member to an indented surface, wherein the second portion is associated with the cradle portion;

(b) a first container defining a chamber containing developer particles, wherein the first container includes one or more outer surface protuberances, wherein the first container is partially disposed in the container receiving space and at least a portion of the first flange and at least a portion of the second flange contact the outer surface of the first container to define a first region of the outer surface of the first container below the first flange and the second flange, wherein the one or more protuberances, disposed in the first region, minimize movement of the first region above the first flange and the second flange by engaging the first flange or the second flange when the first container is subjected to movement out of the receiving space, thereby coupling the first container to the coupling member;

(c) a second container defining a chamber for storing waste marking particles, wherein the second container includes an indented surface, and wherein the indented surface is coupled with the coupling means; and (d) a charge-retentive surface.

17. The apparatus of claim 16, wherein the developer particles comprise a mixture of toner particles and carrier particles.

18. A coupling member comprising:

(a) a cradle portion defining a container receiving space for receiving a first container, and including a first side end having a first flange which extends into the receiving space and a second side end having a second flange which extends into the receiving space; and (b) means for coupling the coupling member to a second container, wherein the coupling means is associated with the cradle portion, wherein the coupling means comprises a plate having a top side and a bottom side, a first L-shaped member and an opposed second L-shaped member, both the first and the second L-shaped members being joined to the bottom surface, wherein one leg of the first L-shaped member is parallel to the plate and defines a first groove engaging surface, wherein one leg of the second L-shaped member is parallel to the plate and defines a second groove engaging surface.

* * * * *